US006223005B1

(12) United States Patent
Rush et al.

(10) Patent No.: US 6,223,005 B1
(45) Date of Patent: Apr. 24, 2001

(54) MULTI-LEVEL OILING DEVICE AND PROCESS FOR A FUSER SYSTEM

(75) Inventors: Edward Alan Rush; Michael David Maul, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/548,924

(22) Filed: Apr. 13, 2000

(51) Int. Cl.[7] ..... G03G 15/20
(52) U.S. Cl. ..... 399/45; 399/67; 399/325
(58) Field of Search ..... 399/45, 67, 68, 399/138, 325, 326

(56) References Cited

U.S. PATENT DOCUMENTS

| | | | |
|---|---|---|---|
| 3,186,838 | | 6/1965 | Graff et al. . |
| 3,649,992 | | 3/1972 | Thettu . |
| 3,706,491 | | 12/1972 | Furman et al. . |
| 3,868,744 | | 3/1975 | Thettu . |
| 4,040,383 | | 8/1977 | Vandervort . |
| 4,049,213 | | 9/1977 | Hank et al. . |
| 4,111,378 | | 9/1978 | Barwick . |
| 4,151,403 | | 4/1979 | Woolston . |
| 4,456,193 | | 6/1984 | Westover . |
| 4,485,982 | | 12/1984 | St. John et al. . |
| 4,535,950 | | 8/1985 | Linsyanski . |
| 4,791,447 | | 12/1988 | Jacobs . |
| 4,835,698 | | 5/1989 | Beery et al. . |
| 4,899,197 | | 2/1990 | Davis et al. . |
| 4,913,366 | | 4/1990 | Andou . |
| 5,045,890 | | 9/1991 | DeBolt et al. . |
| 5,170,214 | | 12/1992 | Negoro et al. . |
| 5,202,734 | | 4/1993 | Pawlik et al. . |
| 5,218,410 | | 6/1993 | Nkabayashi et al. . |
| 5,221,948 | | 6/1993 | Dalal . |
| 5,280,274 | | 1/1994 | Uemura et al. . |
| 5,289,246 | | 2/1994 | Menjo . |
| 5,323,217 | | 6/1994 | Christy et al. . |
| 5,327,203 | * | 7/1994 | Rasch et al. . |
| 5,353,107 | | 10/1994 | Sculley et al. . |
| 5,420,678 | | 5/1995 | Rasch et al. . |
| 5,452,065 | | 9/1995 | Bell . |
| 5,482,552 | | 1/1996 | Kikukawa et al. . |
| 5,506,669 | | 4/1996 | Inoue et al. . |
| 5,594,540 | | 1/1997 | Higaya et al. . |
| 5,609,685 | | 3/1997 | Fux . |
| 5,625,859 | | 4/1997 | Moser . |
| 5,678,133 | | 10/1997 | Siegel . |
| 5,708,914 | * | 1/1998 | Mills et al. ..... 399/45 |
| 5,732,316 | * | 3/1998 | Yamasaki et al. ..... 399/325 X |
| 5,749,036 | | 5/1998 | Yoda et al. . |
| 5,797,063 | | 8/1998 | Umezawa et al. . |
| 5,800,908 | | 9/1998 | Hobson et al. . |
| 5,816,165 | | 10/1998 | Huston . |
| 5,825,374 | | 10/1998 | Albertalli et al. . |
| 5,852,462 | | 12/1998 | Lloyd et al. . |
| 5,852,761 | | 12/1998 | Marcelletti et al. . |
| 5,853,832 | | 12/1998 | Iskikawa . |
| 5,887,235 | | 3/1999 | Wayman et al. . |
| 5,890,032 | | 3/1999 | Aslam et al. . |
| 6,088,546 | * | 7/2000 | Inoue et al. ..... 399/45 |
| 6,101,345 | * | 8/2000 | Van Goethem et al. ..... 399/69 |

FOREIGN PATENT DOCUMENTS

| | | | |
|---|---|---|---|
| 58-216273 | * | 12/1983 | (JP) . |
| 11-231710 | * | 8/1999 | (JP) . |

* cited by examiner

*Primary Examiner*—Joan Pendegrass
(74) *Attorney, Agent, or Firm*—Taylor & Aust, P.C.

(57) ABSTRACT

A multi-level oiling device and process for a fuser system of an imaging apparatus in which the rate at which oil is applied to the fuser roll is controlled with respect to the need for oil. The rate of oil application can be controlled depending on the release characteristics of the media being printed and on the desired glossiness of the printed image. User entered and/or machine sensed data may be used in determining the need for oil application.

12 Claims, 3 Drawing Sheets

MULTI-LEVEL OILING DEVICE AND PROCESS FOR A FUSER SYSTEM

BACKGROUND OF THE INVENTION

1. Related Applications

This application relates to contemporaneously filed applications Ser. No. 09/548,922, entitled "Constant Displacement Oil Web System and Method of Operating the Same", and Ser. No. 09/548,922, entitled "Multi-Level Oiling Device Drive Mechanism", both of which are expressly incorporated herein by reference.

2. Field of the Invention

The present invention relates to an electrophotographic imaging apparatus, and more particularly to a fuser oiling apparatus and the associated method involved with its use and operation.

3. Description of the Related Art

In an imaging apparatus, such as a laser printer using the electrophotographic process, an electrostatic image is created upon a photosensitive member, such as a roll or belt. Visible electroscopic marking particles, commonly referred to as toner, are applied to the electrostatic image on the photosensitive material. Thereafter, the toner is transferred to the desired media, which may include paper, transparency sheets or the like.

The toner image applied to the media is not permanent, however, until the toner is fixed by the application of heat. The toner is elevated in temperature sufficiently to cause constituents of the toner to become tacky, and flow into the pores or interstices between fibers of the media. Upon cooling, the toner again solidifies, causing the toner to adhere to the media. Pressure may be applied to enhance the flow of the toner, and thereby improve the subsequent bonding of the toner to the media.

Thermally fixing the electroscopic toner images commonly has been accomplished by passing the media, with the toner image thereon, through a nip formed by opposed rolls, at least one of which is heated internally. The heated roll, transferred thereafter elsewhere in the apparatus. The presence of wayward toner particles in the imaging apparatus can degrade the quality of the printed sheets.

To reduce sticking and toner offset to the fuser roll, fusers of the type described above commonly employ an apparatus for applying a release fluid to the surface of the fuser roll. The release fluid creates a weak boundary between the heated roll and the toner, thereby substantially minimizing the offset of toner to the fuser roll, which occurs when the cohesive forces in the toner mass are less than the adhesive forces between the toner and the fuser roll. Silicone oils having inherent temperature resistance and release properties suitable for the application are commonly used as release fluids. Polydimethylsiloxane is one such suitable silicone oil that has been used advantageously in the past.

Several methods and apparatuses have been used to supply oil to the fuser hot roll, including oil wicking systems, oil delivery rolls and oil webs. Oil wicking systems include reservoir tanks of the desired release agent or oil, and a piece of fabric wick material having one end mounted in the reservoir and the other end spring biased against the hot roll. Oil from the reservoir is drawn through the fabric wick by capillary action, and is deposited against the roll surface. While a wicking system can be effective in supplying oil to the fuser roll, surface deposit of the oil on the roll can be inconsistent, and the replenishment or replacement of the oil and/or system can be difficult and messy. Further, oil wicking systems can be designed only for a single oil delivery rate, determined by the rate of capillary action of the oil through the wick. By necessity, the delivery rate must be for the maximum oil demand for the print processes to be performed, and the media types to be used in the imaging apparatus. This can result in the over-application of oil under some conditions.

Oil delivery roll systems used in the past commonly include a roll nipped against the hot fuser roll, and either freely rotating against the fuser roll or driven against the fuser roll through a gear train. Oil delivered to the surface of the oil delivery roll is deposited on the hot fuser roll as the rolls rotate against each other. Various structures have been used for providing oil to the surface of the oil delivery roll, including reservoirs at the center of the roll, which may include a hollow tube filled with oil, providing oil to the surface through small tubes or via capillary action through the outer material. Felts or metering membranes may be used in the oil delivery roll to control the oil flow through the roll. Another style of oil delivery roll, referred to as a web-wrapped roll, includes high temperature paper or non-woven material saturated with oil, and wrapped around a metal core. Similarly to oil wicking systems, oil delivery rolls can be designed for a single delivery rate only, and can create excessive oil application under some operating conditions of the imaging apparatus.

Conventional oil web systems include a supply spool of web material, generally being a fabric of one or more layers saturated with the desired oil. Commonly, the web material is a non-woven fabric of polyester and aramid fibers, such as Nomex® manufactured by DuPont. A take-up spool is provided for receiving the used web. A web path, commonly including one or more guide rolls, extends from the supply spool to the take-up spool. A portion of the web path brings the web material into contact with the hot fuser roll, either by wrapping a portion of the web around the hot roll, or by utilizing a spring- loaded idler roll to nip the web material against the fuser roll. As the fuser roll rotates against the web in contact therewith, oil is transferred from the web to the fuser roll. Periodically, a drive mechanism for the take-up spool activates, rotating the spool and advancing web material from the supply spool to the take-up spool, thereby bringing a fresh section of web material into contact with the fuser roll.

Such conventional oil web systems can be used to deliver oil at a relatively constant rate with good uniformity. However, the oil flow is dependent on the amount of material brought into contact with the fuser roll over a given period of time. In oil web systems utilized heretofore, the simplified drive systems for the take-up roll have been operated for consistent durations at constant intervals throughout the life of the web system. Therefore, as spent material passes onto the take-up spool, and the diameter of the take-up spool increases, the linear length of material brought into contact with the fuser roll increases during each web advancement, thereby increasing the amount of oil deposited on the fuser roll.

An improved oil web system is described in our co-pending patent application entitled "Constant Displacement Oil Web System, And Method For Operating The Same" filed on even date herewith. In the improved system described therein, the problem of the incremental increase in the linear advancement of the web as the take-up spool diameter increases has been solved by adjustment of the drive mechanism operating cycle. However, the oil web system described therein also provides only a single oil application rate, regardless of the media type being printed.

The design oil application rate must meet the maximum demand for oil required by the imaging apparatus design parameters, and can result in excess oil application under some conditions.

Excess oil on the fuser roll has undesirable effects. Since the paper passing through the fuser system generally carries away a portion of the oil deposited on the fuser roll, an excess amount of oil on the fuser roll, when picked up by the paper or other media, can cause an undesirable glossy appearance to the media. In duplexing systems, oil carried on the first printed side can be transferred to other areas of the imaging apparatus, when the media passes again through the apparatus for printing on the second side. Excessive amounts of oil deposited in other sections of the imaging apparatus can decrease print quality and otherwise produce undesirable operating effects. Additionally, unnecessary advancement of the web is wasteful, and shortens the useful life of the oiling system, necessitating replacement.

While excessive amounts of oil can result in problems and difficulties as mentioned above, controlling the amount of oil applied to the fuser roll can alter the appearance of the image on the printed sheet. It is often desirable that the printed image has glossiness similar to the glossiness of the media on which it is printed. Glossiness of the toner image is partially determined by the ease of release of the toner from the fuser roll. Therefore, if slightly more oil is applied to the fuser roll, a higher gloss can be achieved for the printed image as release of the toner from the fuser roll would be enhanced, and roughness of the toner image would be minimized. Conversely, if a duller or matte appearance is desired for the printed image, the use of slightly less oil on the fuser roll would result in a slightly increased tendency of the toner to adhere to the fuser roll, thereby creating the matte or dull look to the print. However, an adjustable oiling apparatus to control glossiness has not been available heretofore.

What is needed is a multi-level oiling device for an imaging apparatus fuser drum in which the application rate of oil can be varied, to more closely meet the requirements of the imaging apparatus operating conditions. More specifically, what is needed is an oil web system for an imaging apparatus in which the indexing increment length and frequency of the oil web can be varied to meet release demands of the media being processed, or the user preferences for printed appearance of the media.

SUMMARY OF THE INVENTION

The present invention provides an imaging apparatus having an oil web system employing a multi-level oil displacement rate for applying oil on the fuser roll.

The invention comprises, an oil carrying web provided on a supply spool; a take-up spool for spent web from which the oil has been transferred to the fuser roll; a drive mechanism for rotating the take-up spool; and one or more web guiding members defining a web path such that, along at least a portion of the path, the web material is brought into contact with the fuser roll. In accordance with one feature of the invention, a drive mechanism control receives input regarding the media type being processed through the imaging apparatus, and controls operation of the drive mechanism to minimize over-application of oil on the fuser roll. Media type information can be provided from media supply cassette data entered for each media supply cassette, from user input at the control panel or from media sensor data generated in the imaging apparatus.

In accordance with a second feature of the invention, the drive mechanism control receives input with respect to print copy glossiness preferences, and controls operation of the drive mechanism to apply more or less oil, to achieve the desired level of glossiness. The glossiness preferences can be pre-established or from preference data entered by the user at an interface panel.

An advantage of the present invention is the reduction of waste in the oil web system and the resulting prolonged life of the system.

Another advantage of the present invention is the control of printed sheet glossiness characteristics in response to user preferences.

Yet another advantage of the present invention is the minimization of oil dumps and, therefore, the reduction of oil carry over by printed media and resulting contamination of other portions in the imaging apparatus.

BRIEF DESCRIPTON OF THE DRAWINGS

The above-mentioned and other features and advantages of this invention, and the manner of attaining them, will become more apparent and the invention will be better understood by reference to the following description of the embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
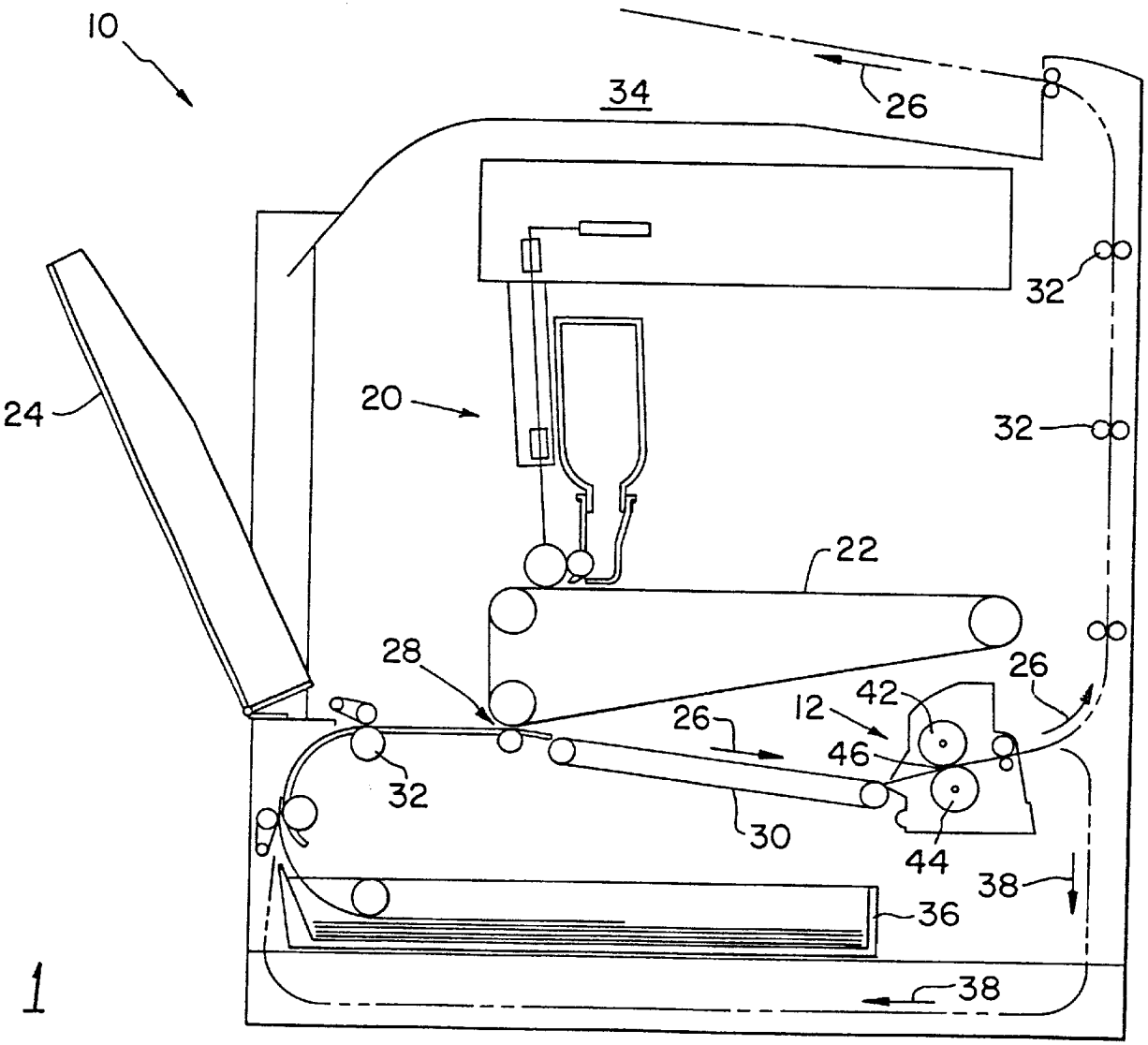
FIG. 1 is a simplified schematic representation of an imaging apparatus in which the present invention may be used advantageously.

Referring now more specifically to the drawings, and to FIG. 1 in particular, an imaging apparatus in the form of a laser printer 10 is shown, in which a multilevel oiling device and process of the present invention may be used advantageously. Laser printer 10 includes a fuser 12 and an oil web system 14 (FIG. 2), which is operated in accordance with a media requirements control process 16 shown in FIG. 4, a glossiness preference control process 18 shown in FIG. 5, or a combination thereof.

Laser printer 10 includes a printhead 20, which, in known fashion, creates an electrostatic image on an image transfer belt 22. Media from a media supply tray 24 or 36 is moved along a media path, which is indicated in the drawings by the arrows 26, and includes processing through an image transfer nip 28 and fuser 12. The media path includes a plurality of guide surfaces or belts 30 and guide rolls 32 to direct the media through printer 10, ending at a media receiving zone 34. The media path may further include a duplexing side path including an alternate path indicated by the arrows 38.

Those skilled in the art will readily understand the manner in which printhead 20 creates an electrostatic image on a photosensitive member, such as the image transfer belt 22. The image is further processed by the attachment of toner particles, which in a color printer may include particles of different colors. Thereafter, the toner image is transferred to the media sheets at image transfer nip 28, and the sheet is processed through fuser 12, wherein the image is fixed through the application of heat and pressure.

Fuser 12 includes a hot roll 42 and a backing roll 44, creating a fuser nip 46 through which the media passes. Heat and pressure are applied to the media as it passes through fuser nip 46. Oil web system 14 is provided to prevent sticking between the media and hot roll 42, and to minimize toner offset to hot roll 42. Oil web system 14 applies a release agent, such as silicone oil, to the surface of hot roll 42. Oil on the surface of fuser hot roll 42 minimizes the sticking and toner off-set problems that can be encountered.

It should be recognized that the laser printer 10 shown in FIG. 1 is merely the representation of a suitable apparatus in which the present invention may be used advantageously. It should be further understood that other types of laser printers, other types of printers generally, and other types of imaging apparatus may advantageously use the present invention as well. Printer 10, shown in FIG. 1, is merely one such device provided and described herein for ease of understanding the use of the present invention, and should not be considered as a limitation on the invention, nor on the claims to follow.

Oil web system 14 (FIG. 2) includes a material web 52 of suitable material for holding release agent. A non-woven fabric of polyester and aramid fibers, such as Nomex® manufactured by and available from DuPont, has been used advantageously in the past. The material is coated or saturated with a release agent, such as a silicone oil of polydimethylsiloxane or the like. Web 52 is a relatively thin elongated band of material stored on a supply spool 54 prior to its use in oil web system 14. A take-up spool 56 is provided for receiving used or spent portions of web 52. Between supply spool 54 and take-up spool 56, material web 52 extends along a web path which is indicated in the drawings by arrows 58. The web path is defined by web guiding members, which may include supply spool 54, take-up spool 56 and other rolls or surfaces influencing the position of web 52. Along at least a portion of the web path, web 52 is brought into contact with hot roll 42 of fuser 12. Release agent is transferred from web 52 to hot roll 42 at an oil transfer nip 60. In the embodiment shown, oil transfer nip 60 is created by the close proximity of a spring-loaded biasing roll 62 to hot roll 42, which holds web 52 against hot roll 42 at oil transfer nip 60. It should be understood that other arrangements may be used advantageously to bring portions of web 52 into contact with hot roll 42. For example, two or more rolls may be used to position web 52 such that a segment of web 52 wraps a portion of hot roll 42. Alternatively, the relative positions of a single idler roll and take-up pool 56 may be such as to cause a portion of web 52 to wrap a portion of hot roll 42.

In oil transfer nip 60, or other transfer area at which oil is deposited on hot roll 42, the surface of hot roll 42 and web 52 move in opposite directions. As a result, tension is applied to web 52 between biasing roll 62 and take-up spool 56, and, therefore, the roll up of the web 52 on take-up spool 56 is under tension. Tension in the roll-up creates a neat, clean wind up of web 52 on take-up spool 56. Further, tension is relieved from the segment of web 52 between supply spool 54 and biasing roll 62, to prevent an unintentional unwind of supply spool 54 and the resultant over application of oil on fuser hot roll 42.

To effect transfer of web 52 from supply spool 54 to take-up spool 56, a drive mechanism 64 is provided, which may include an independent, dedicated prime mover and gear train, a gear train from a common drive for other apparatus in the printer, a direct drive prime mover, or the like. The prime mover may be a stepper motor, a solenoid, or other positional activator. Such drive mechanisms are known in the industry, and will not be described in further detail herein. Operation of drive mechanism 64 is controlled by drive controller 66, which transmits signals to drive mechanism 64, including start and stop signals, via a signal pathway 68.

In accordance with one embodiment of the aforementioned co-pending patent application entitled "Constant Displacement Oil Web System And Method Of Operating The Same" a web advancement sensor system 70 is provided. Web advancement sensor system 70 includes an idler shaft 72, a web engagement portion 74 of idler shaft 72 and an encoder wheel 76 connected thereto. Idler shaft 72 is journaled in suitable bearings and/or bushings (not shown) to allow its relatively free rotation therein. Idler shaft 72 and engagement portion 74 are positioned in oil web system 14 such that engagement portion 74 is partially wrapped by web 52. Commonly, this will be in the segment of web 52 between biasing roll 62 and take-up spool 56, such that the tensioned portion of web 52 rotates the idler shaft as linear advancement of the web 52 occurs.

Figure 2:
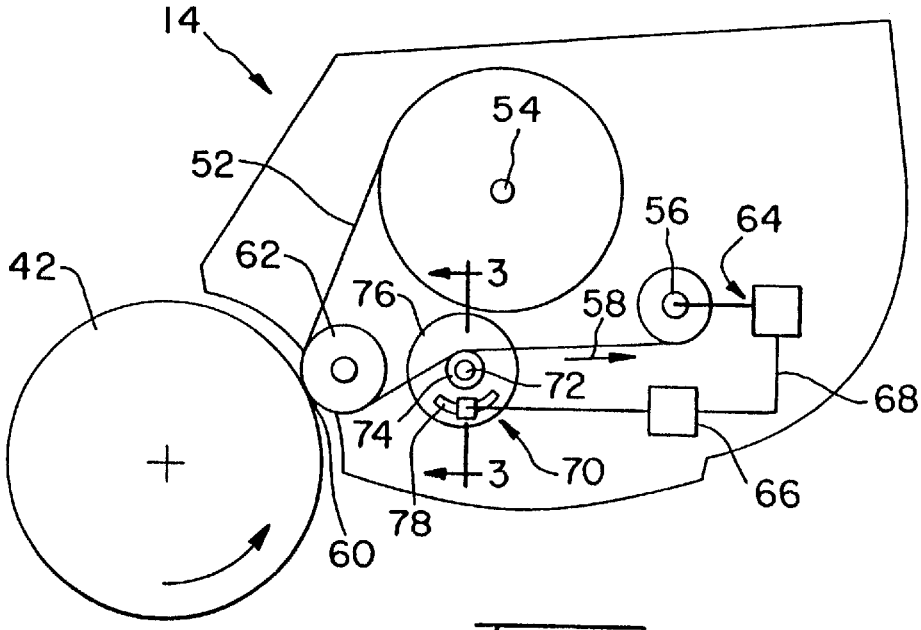
FIG. 2 is a simplified schematic representation of an oil web system.
Figure 3:
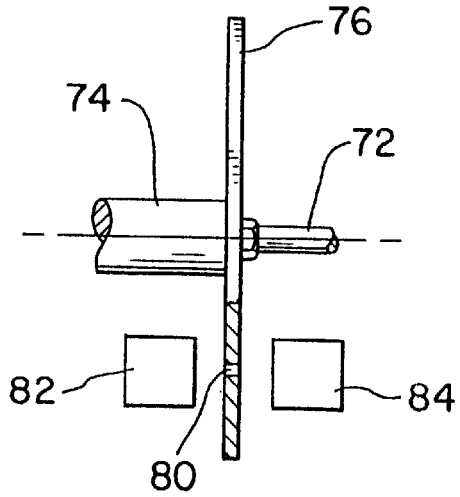
FIG. 3 is a cross-sectional view of the oil web system shown in FIG. 2, taken along line 3—3 of FIG. 2.

Encoder wheel 76 is connected to idler shaft 72, or to engagement portion 74, for rotation therewith. Encoder wheel 76 includes surface indicia, holes or the like, movement of which may be detected by an appropriate sensor. In the embodiment shown, a band or region 78 is provided near the periphery of encoder wheel 76. Within the band or region 78, a hole or opening 80 (FIG. 3), or a plurality thereof are provided, and may be in specific patterns or orientations. Although band or region 78 is shown in FIG. 2 as only a small segment on encoder wheel 76, band or region 78 may extend along a greater portion or entirely around encoder wheel 76, near the periphery thereof. A transmissive sensor of known design is used, and includes an emitter 82 disposed on one side of encoder wheel 76, and a receiver 84 disposed on the side of encoder wheel 76 opposite emitter 82. In known fashion, emitter 82 emits a beam of light, or the like, and receiver 84 is positioned to receive the emitted beam as it passes through hole or holes 80. Thus, emitter 82 and receiver 84 are used to detect movement of encoder wheel 76, as evidenced by the passage of hole or holes 80 through the area between emitter 82 and receiver 84. From the frequency of passage of hole or holes 80, or the recognition of the pattern of passing between emitter 82 and receiver 84, the web advancement sensor system 70 provides a signal representative of the linear advancement of web 52.

The structures and operations of appropriate sensors that may be used in the present invention, to ascertain the pattern or frequency of hole 80 passings are known for other uses, and will not be described in further detail herein.

Other types of web movement sensors may be used advantageously in the present invention. A system using an encoder wheel 76, emitter 82, and receiver 84 as shown and described is a preferred, low cost and accurate alternative.

Figure 4:
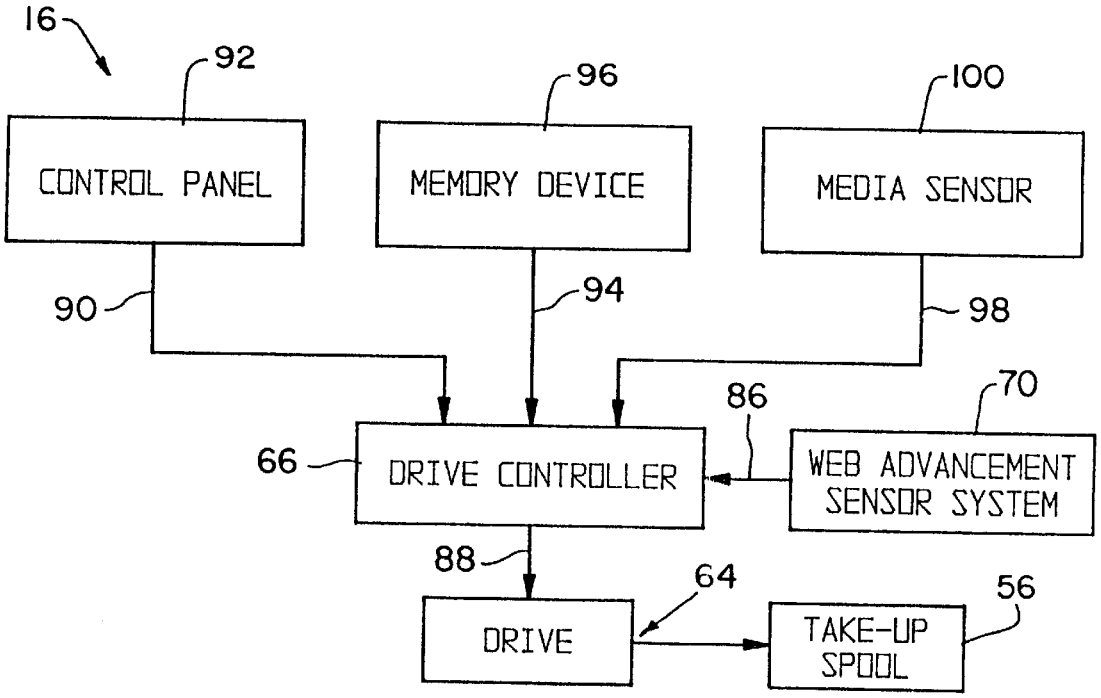
FIG. 4 is a flow diagram schematic representation of a process control for an oil web system accordance with one aspect of the present invention.

In accordance with a first aspect of the present invention, advancement of web 52, and application of oil to fuser hot roll 42, are controlled with consideration to characteristics of the media being printed, as shown in media requirements control process 16, shown schematically in FIG. 4. In accordance with a second aspect of the present invention, advancement of web 52, and application of oil to fuser hot roll 42, are controlled with consideration to preferences for glossiness of the printed image, as shown in glossiness preference control process 18 in FIG. 5. In each of processes 16 and 18, drive controller 66 receives a web advancement data signal via a signal pathway 86 from the web advancement sensor system 70, and processes the signal to determine the actual linear advancement of web 52. Drive controller 66 transmits drive control signals via a drive control signal pathway 88 to drive mechanism 64, to start and stop drive mechanism 66 for rotation of take-up spool 56.

In media requirements control process 16 shown schematically in FIG. 4, drive controller 66 additionally receives data signals regarding the media type to be used. Different media have different print characteristics, and different tendencies to stick to the fuser hot roll 42. Therefore, the need for oil on roll 42 differs from one media type to another. The media type information can be user entered data signals received by drive controller 66 via a signal pathway 90 from a user interface control panel 92. Control panel 92 can be on the printer 10, or may be a workstation or personal computer transmitting print job instructions from word processing software. Additionally, the media type information can be memory resident or stored data transmitted to drive controller 66 via a signal pathway 94 from a memory device 96, such as encoded or stored information regarding the content of media supply tray 24. As yet another alternative, the media type information can be sensor data signals transmitted to drive controller 66 via a signal pathway 98 from a media sensor 100 disposed in media path 26. Controller 66 processes user entered data signals received on signal pathway 90, memory resident or stored data signals received on signal pathway 94 and sensor data signals received on signal pathway 98, together with stored look-up tables or the like, to determine the preferred oil application rate for the media being processed. Thus, release characteristics of the media can be considered in determining the need for oil application on fuser hot roll 42. In conjunction with data signals received from signal pathway 86 regarding actual linear advancement of web 52, drive controller 66 determines the appropriate interval and duration for indexing web 52, and transmits drive control signals 88 to drive mechanism 64 based thereon.

Figure 5:
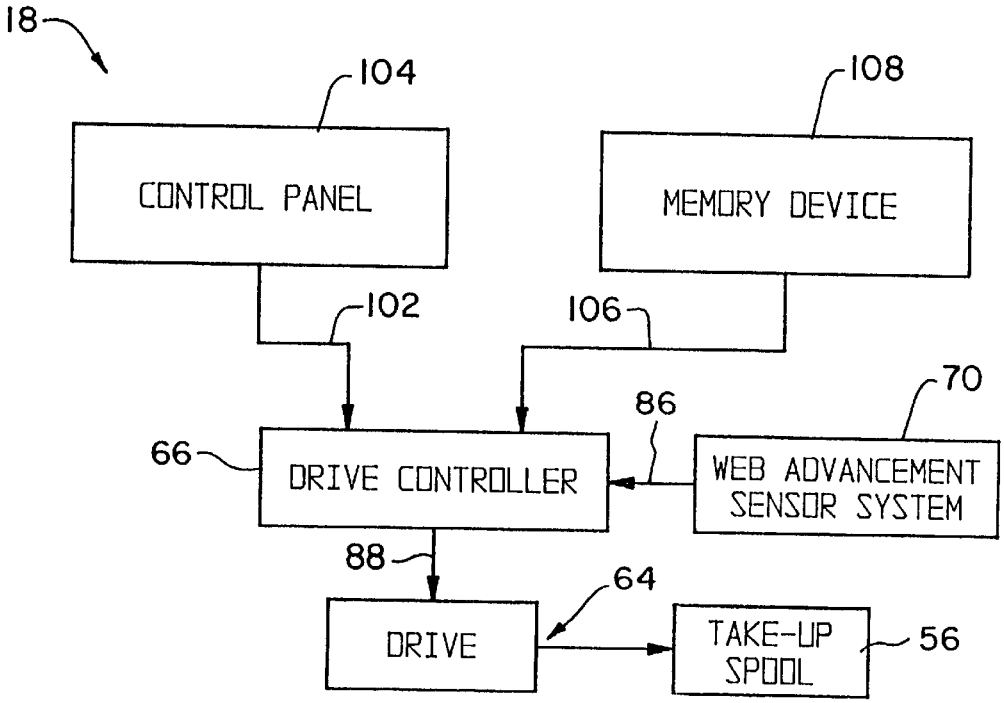
FIG. 5 is a flow diagram schematic representation of a process control for an oil web system in accordance with a second aspect of the present invention.

In the glossiness preference control process 18 shown schematically in FIG. 5, drive controller 66 receives data signals regarding the desired glossiness of the image on the media being processed. The data may be user entered glossiness data signals transmitted via a signal pathway 102 from a user interface control panel 104, similar to control panel 92. Stored glossiness preference data signals also may be transmitted via a signal pathway 106 from a memory device 108 to apply preferences on glossiness characteristics that are established as part of equipment set-up. Drive controller 66 utilizes user entered glossiness data signals received via signal pathway 102, and stored glossiness data signals received via signal pathway 106, with stored information in the nature of look-up tables or the like, to determine the rate at which oil should be applied to fuser hot roll 42 to achieve the desired glossiness level. Encoder wheel signals received via signal pathway 86 are used to determine the actual performance of drive mechanism 64. The actual performance data is used to generate drive control signals transmitted via signal pathway 88 relating to the frequency and duration of web advancement steps.

It should be understood that media requirements control process 16 and glossiness preference control process 18, may be used independently of each other. Alternatively, for greater print quality control, the two control processes may be combined in a single process control, such that the appropriate indexing frequency and duration is determined by the drive controller 66 based on both the media type being used and the desired glossiness of the image. The individual characteristics of the media, as they affect both glossiness and sheet release from fuser hot roll 42 can be considered in determining the need for oil application.

Through use of the present invention, desired glossiness characteristics can be achieved and the appropriate amount of release agent can be applied for the media being processed and the desired level of glossiness on the media. Waste is reduced and machine contamination through over application of oil is minimized.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multi-level oiling device for a fuser roll in a fuser system of an imaging apparatus, comprising:

an elongated web having fuser roll release agent carried thereby;

a supply spool for holding an unused portion of said web;

a take-up spool for holding a used portion of said web;

a plurality of web guiding members defining a web path from said supply spool to said take-up spool, said web path being configured for biasing a portion of said web against the fuser roll, for transferring release agent from said web to the fuser roll;

a drive mechanism operatively connected to said take-up spool for rotating said take-up spool; and a controller for activating and deactivating said drive mechanism, said controller being operatively connected to receive data signals regarding at least one of a glossiness preference and a media type identification, and said controller being adapted to process said data signals and adjust an operating cycle for said drive mechanism in response to a need for release agent.

2. The multi-level oiling device of claim 1, further comprising a user interface control panel for generating user entered data signals regarding glossiness preference, and a signal pathway between said user interface control panel and said controller.

3. The multi-level oiling device of claim 1, further comprising a user interface control panel for generating user entered data signals regarding media type identification, and a signal pathway between said user interface control panel and said controller.

4. The multi-level oiling device of claim 3, further comprising a user interface control panel for generating user entered data signals regarding glossiness preference, and a signal pathway between said user interface control panel and said controller.

5. The multi-level oiling device of claim 1, further comprising a media sensor providing sensor data signals regarding media type identification, and a signal pathway between said media sensor and said controller.

6. The multi-level oiling device of claim 5, further comprising a user interface control panel for generating user entered data signals regarding glossiness preference, and a signal pathway between said user interface control panel and said controller.

7. The multi-level oiling device of claim 5, further comprising a memory device providing memory resident data signals regarding glossiness preference, and a signal pathway between said memory device and said controller.

8. The multi-level oiling device of claim 1, further comprising a memory device providing memory resident data signals on media type identification, and a signal pathway between said memory device and said controller.

9. The multi-level oiling device of claim 8, further comprising a memory device providing memory resident data signals regarding the glossiness preference, and a signal pathway between said memory device and said controller.

10. The multi-level oiling device of claim 1, further comprising a memory device providing memory resident data signals regarding the glossiness preference, and a signal pathway between said memory device and said controller.

11. The multi-level oiling device of claim 10, further comprising a memory device providing memory resident data signals regarding the glossiness preference, and a signal pathway between said memory device and said controller.

12. The multi-level oiling device of claim 1, further comprising a user interface control paneling for generating user entered data signals regarding glossiness preference, a signal pathway between said user interface control panel and said controller, a memory device providing memory resident data signals on media type identification, and a signal pathway between said memory device and said controller.

* * * * *